US005928845A

United States Patent [19]

Feumi-Jantou

[11] Patent Number: 5,928,845

[45] Date of Patent: Jul. 27, 1999

[54] METHOD OF FIXING A PHOTOGRAPHIC PRODUCT

[75] Inventor: Christiane B. Feumi-Jantou, 71100 Chalon-Sur-Saone, France

[73] Assignee: Eastman Kodak Company, Rochester, N.Y.

[21] Appl. No.: 09/104,547

[22] Filed: Jun. 25, 1998

[30] Foreign Application Priority Data

Jun. 25, 1997 [FR] France ..... 97 08298

[51] Int. Cl.[6] ..... G03C 5/26

[52] U.S. Cl. ..... 430/432; 430/404

[58] Field of Search ..... 430/432, 404

[56] References Cited

U.S. PATENT DOCUMENTS

| | | | |
|---|---|---|---|
| 3,238,043 | 3/1966 | Levy | 430/456 |
| 3,573,912 | 4/1971 | Brown | 430/346 |
| 5,758,223 | 5/1998 | Kobayashi et al. | 396/627 |
| 5,789,144 | 8/1998 | Thomas | 430/404 |
| 5,832,328 | 11/1998 | Ueda | 396/627 |

FOREIGN PATENT DOCUMENTS

| | | |
|---|---|---|
| 54 881 | 3/1967 | Germany . |
| 55547 | 4/1967 | Germany . |
| 2304200 | 3/1997 | United Kingdom . |

*Primary Examiner*—Hoa Van Le
*Attorney, Agent, or Firm*—J. Lanny Tucker

[57] ABSTRACT

The present invention concerns a novel method of processing a photographic product that comprises a step of fixing by surface application of a fixing solution. This processing method affords efficacious fixing with a reduced quantity of fixing solution.

9 Claims, 2 Drawing Sheets

METHOD OF FIXING A PHOTOGRAPHIC PRODUCT

FIELD OF THE INVENTION

The present invention concerns a novel method of processing a photographic product. In particular, the invention concerns a method of processing a photographic product which comprises a fixing step by surface application and to a fixing solution useful therein.

PRIOR ART

Conventionally, the development of a black-and-white photographic product comprises a development step, a fixing step and a washing step. The processing of color photographic products comprises a color development step, a bleaching step, a fixing step and a washing step. The fixing step eliminates the silver ions still present in the developed photographic product by solubilizing these ions in a fixing solution.

Conventionally, the fixing solution contains a solvent for silver halides which, by reacting with the silver ions, forms a water-soluble silver complex. This silver complex is then eliminated from the photographic product during the washing step. The efficiency of the fixing is related to the diffusion of the silver halide solvent through the gelatin-containing layers of the photographic product.

Conventionally, the fixing step is implemented in a tank in which the developed photographic product is immersed. Conventionally, stirring is maintained in the tank in order to facilitate the diffusion of the solvent in the photographic layers and thus facilitate the formation of the silver complex which will be eliminated by washing. The duration of the fixing depends on the thickness of the layers, the silver content of these layers, and the way in which the fixing step is performed. Conventional fixing solutions are aqueous solutions containing thiosulfates, cyanides, ferrocyanides, etc. In tank processes, it is necessary to use a quantity of fixing solution of at least 300 ml/m$^2$.

Efficient fixing of the photographic product therefore requires the use of large volumes of fixing solution. Recycling or destroying these fixing solutions gives rise to numerous problems, in particular with regard to environmental protection. These problems are all the greater since the standards for discharging chemical solutions are becoming more and more strict. It is therefore desirable to develop a photographic processing system which uses reduced quantity of solution.

In the photographic processing method, it is important to obtain a fixing which is as complete as possible. Indeed, when the silver halides are not totally transformed into a soluble complex, they are not eliminated from the photographic product by washing. Photographic products where fixing is not complete do not exhibit a good storage and exhibit darkening of the image due to the silver halides still present in the photographic product.

There exist photographic processing systems which consist of developing a photographic product by contacting it with a support impregnated with an active substance. For example, FR 2 003 178 and FR 2 414 743 describe a method of developing a photographic product having incorporated a developing agent which consists of contacting this product with a support covered with gelatin impregnated with a basic activator. This system gives a silver image with a minimum volume of developer. In these two patents, fixing is effected in a conventional fashion in a tank.

SUMMARY OF THE INVENTION

An object of the present invention is to provide a method of processing a photographic product wherein the fixing step is effectively carried out with a reduced quantity of solution.

This object, as well as others, are achieved with the present invention, which concerns a method of processing an exposed photographic product which comprises the following steps:

a) developing the photographic product, b) fixing the developed photographic product, and c) washing the photographic product, the fixing step comprising applying to the surface of the photographic product, a layer of an aqueous fixing solution comprising a concentration of thiosulfate or thiocyanate greater than or equal to 200 g/l, and a photographically inert wetting agent.

Another object of the invention is to provide a fixing solution comprising a fixing agent that is a thiocyanate or thiosulfate or both and a photographically inert wetting agent, the total concentration of fixing agent being greater than or equal to 200 g/l.

The use of a reduced volume of solutions presents numerous advantages with regard to the recycling or destruction of these solutions.

In the scope of the present invention, the processing method comprises a fixing step of a photographic product by surface application, that is to say the exposed photographic product is not immersed in a tank filled with fixing solution until the fixing is ended but the face of the photographic product opposite to the support is covered with a layer of fixing solution.

The application of the fixing solution as a layer can be effected by any known means which makes it possible to apply an aqueous solution uniformly to a plane support in order to form a layer. This application can be effected manually or automatically. For example, it is possible to form such a layer by spraying, immersion, vapor deposition or coating. For reasons of reproducibility, it is preferable to apply the fixing solution automatically.

The viscosity of the fixing solution of the present invention is about the viscosity of water (about 1 cp, 20° C.). This fixing solution does not contain any thickening agent.

DETAILED DESCRIPTION OF THE INVENTION

Surprisingly, by the method of the invention photographic products are effectively fixed with a reduced volume of solution and without stirring. According to the invention, photographic products can be fixed very satisfactorily with a volume of fixing solution of from about 20 to about 200 ml/m$^2$, and preferably from about 20 to about 100 ml/m$^2$, this quantity varying according to the thickness, the number and the silver content of the layers making up the photographic product to be processed. As shown by the examples of the present invention, it has been possible to fix effectively photographic products having a silver content of from about 2 to about 5 g/m$^2$ with a quantity of fixing solution being from about 20 to about 50 ml/m$^2$.

This method also has the advantage of using a single-use fixing solution for each photographic product processed, thus avoiding contamination of the photographic products thus processed.

Figure 1A:
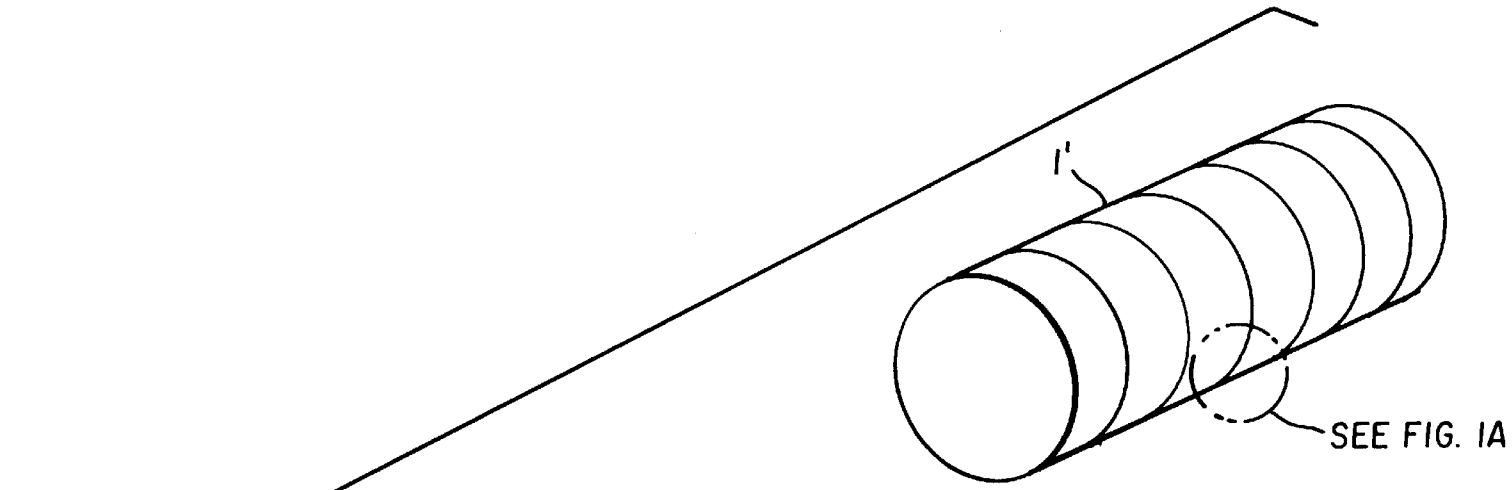
FIGS. 1 and 2 are schematic representations of devices for surface application of the fixing solution according to this invention.
Figure 1A:
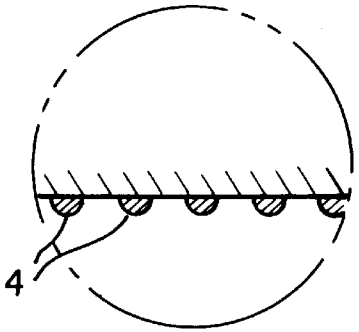
Figure 1:
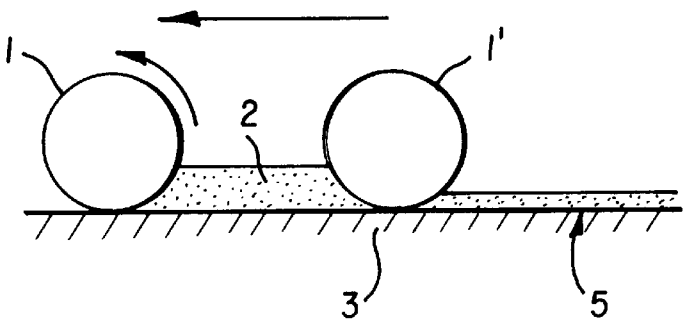

According to a particular embodiment, the fixing solution is applied by means of the device described in FIG. 1, which comprises two rollers (1, 1') connected together and forming a reservoir containing the fixing solution to be coated (2), the whole being placed on the surface of the photographic product (3) to be fixed. The leading roller (1) is covered with flexible rubber, the rear roller (1') is a roller with a ribbed surface (4) which makes it possible to control the coating of the layer of fixing solution (5). The device is equipped with means for automatically moving the device over the product, which makes it possible to deposit a thin uniform layer of fixing solution on the product (not visible in the figure).

Figure 2:
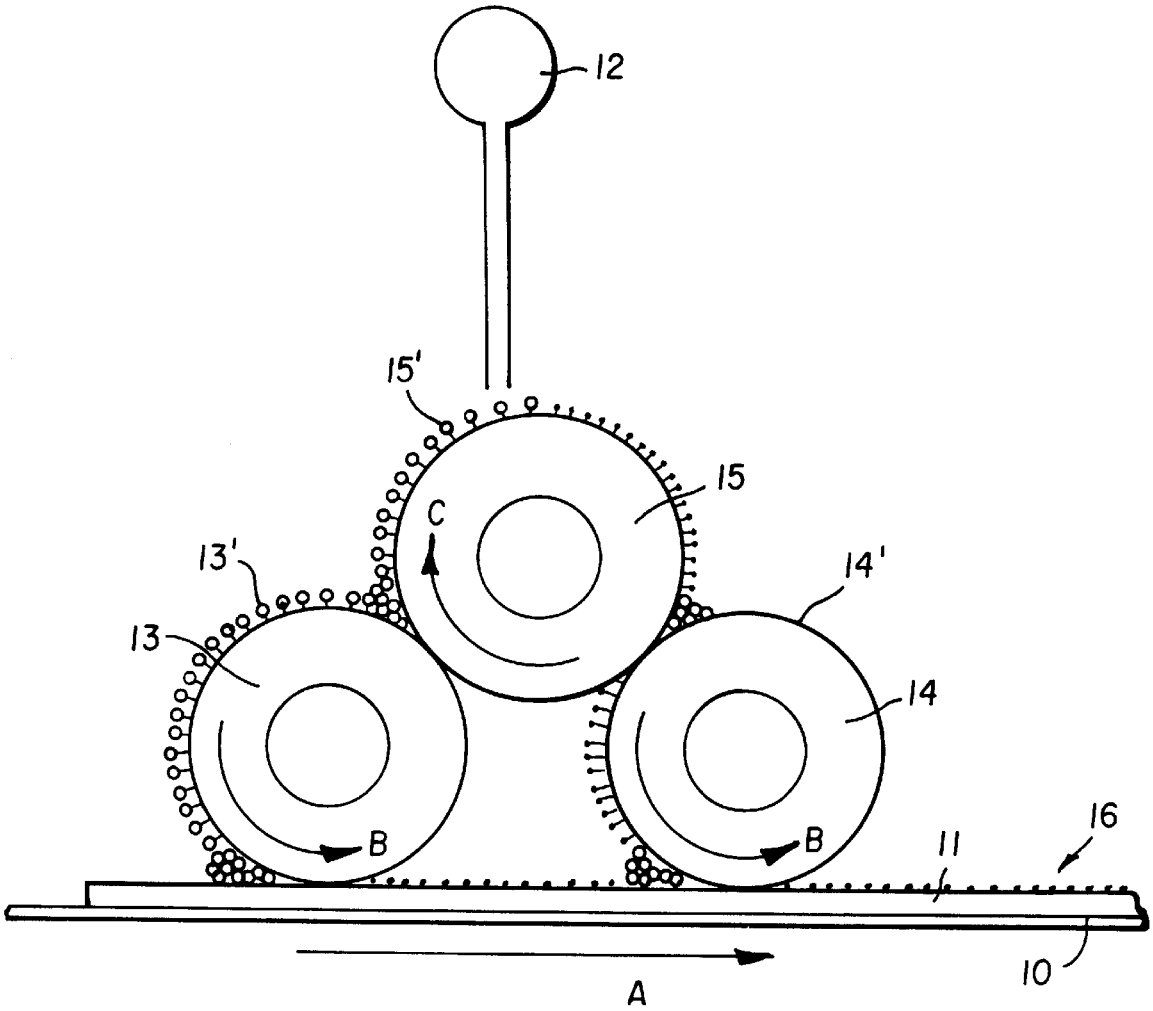

According to another embodiment, the fixing solution is applied by means of the device described in GB publication 9519709.1. This device, described in FIG. 2, comprises a surface (10) which supports the photographic product to be processed (11), a means of conveying the photographic product which does not appear in the figure, a reservoir (12) which delivers a given quantity of fixing solution, a means for applying the fixing solution which comprises at least two bottom rollers (13, 14) in contact with the photographic product to be fixed, and a top roller (15) situated above each of the two bottom rollers (13, 14), the top roller (15) being in contact with the bottom rollers (13, 14). The fixing solution is deposited on the surface of the roller (15') and then flows over the surface of the bottom rollers (13', 14'). When the photographic product is moved in the direction of the arrow (A), the bottom rollers (13, 14) are set in rotation as indicated by the arrows (B, C), which causes the rotation of the top roller (15). This rotation deposits a thin layer (16) of fixing solution on the product to be processed, as shown in FIG. 2.

The use of such a device has made it possible to obtain a particularly efficacious level of fixing by surface application.

These two embodiments are described by way of example; the layer of fixing solution can be formed by any known coating technique.

In the scope of the invention, when the fixing solution comprises a thiosulfate, it can be for example sodium, ammonium or potassium thiosulfate, and preferably ammonium thiosulfate. According to a particular embodiment, the fixing solution comprises a concentration of thiosulfate in the range of from about 200 to about 500 g/l.

In the present invention, when the fixing solution comprises a thiocyanate, the thiocyanate can for example be sodium thiocyanate.

When the fixing solution contains a mixture of a thiosulfate and a thiocyanate, the total concentration of fixing agent is in the range of from about 200 g/l to about 500 g/l. According to a particular embodiment, the concentration of thiocyanate is at least 10% by weight based on the total quantity of fixing agents, and preferably between 20 and 30%.

In the invention, the fixing solution comprises at least one photographically inert wetting agent. "Photographically inert wetting agent" means a surfactant that facilitates the coating of the fixing solution over the product and which promotes chemical exchanges between the fixing solution and the photographic product to be processed without causing any photographic degradation, for example degradation of the gelatin, fogging, etc. This wetting agent facilitates the diffusion of the chemical substances to be eliminated from the photographic layer to the washing solution. This agent makes it possible to obtain a uniform layer of fixing solution on the photographic product to be fixed. It must form a homogeneous solution with the other compounds present in the solution. It must be stable over time. Indeed, the fixing solution must be able to be stored without losing these fixing and/or coating properties.

Provided they meet the above criteria, these wetting agents can be anionic, cationic, non-ionic or amphoteric surfactants, alone or in a mixture. These surfactants are, for example, Zonyl FSN®, Alkanol XC® manufactured by Dupont, Lodyne S-100® manufactured by Ciba-Geigy, Olin 10G® manufactured by Olin Mathieson.

According to one embodiment of the invention, the quantity of wetting agent is from about 0.1 to about 5% by volume of fixing solution.

The processing method of the present invention is in general a conventional processing method which comprises a developing step, a fixing step and a washing step. Such a processing method can if necessary comprise a bleaching step and/or a reversal step. The developing step can be a black-and-white or color developing step.

A black-and-white developing solution is a solution which contains a reducing agent for silver halides such as aminophenols, polyhydroxybenzenes, for example hydroquinone or hydroquinone derivatives, 3-pyrazolidinones, pyrogallol, pyrocathecol, ascorbic acid or derivatives thereof, etc.

The color developing solution are in general solution that contain compounds which, in their oxidized form, react with a dye-forming coupler in order to form a dye image, the coupler being present either in the developing solution or in the photographic product. These compounds are conventionally paraphenylenediamines, for example diethyl-p-phenylenediamine, ethylhydroxethyl-p-phenylenediamine, etc.

Any type of photographic product can be processed with the method of the invention. For example, it is possible to process negative working photographic products, positive working photographic products, black-and-white photographic products for snapshots, black-and-white photographic products such as radiographic products, photographic products for graphic art, color photographic products or reversal photographic products.

According to a particular embodiment, the photographic product is a photographic product having incorporated therein developing agents, which is developed by contact with a basic activator. This activator can be applied as a layer to the surface of the photographic product according to the application method described previously for the fixing solution. In this way the volume of the processing bath and effluents is reduced. Such a developing method was described in FR 9605192.

Photographic products usually comprise a support having thereon on at least one of its faces a layer of silver halide emulsion. Photographic products are described in *Research Disclosure,* September 1994, 368, #36544 (hereinafter referred to as *Research Disclosure*). The silver halide emulsion comprises silver halide grains in a hydrophilic binder, for example gelatin. The different methods of preparing photographic emulsions were described in *Research Disclosure,* Section I-C. The gelatin can be replaced partly by other synthetic or natural hydrophilic colloids such as albumen, casein, zein, a polyvinyl alcohol or cellulose derivatives, for example carboxymethylcellulose. Such colloids are described in Section II of *Research Disclosure.* The silver halide grains can have different morphologies (see Section 1-B of *Research Disclosure*).

*Research Disclosure* Section 1-A describes the silver halide grain compositions. The silver halide grains can comprise silver chloride, bromide, chlorobromide, bromochloride, chloroiodide, bromoiodide or bromochloroiodide. According to a preferred embodiment, the emulsion contains as main silver halide, silver chloride or silver chlorobromide grains.

The silver halide grains can be chemically sensitized as described in *Research Disclosure* Section IV.

The silver halide grains can be spectrally sensitized as described in *Research Disclosure* Section V.

In addition to the compounds cited above, the photographic product can contain other photographically useful compounds, for example coating aids, stabilizers, plasticizers, antifogging agents, hardening agents, antistatic agents, matting agents etc. Examples of these compounds are described in *Research Disclosure* Sections VI, VII, VIII, and X.

The supports which can be used in photography are described in Section XV of *Research Disclosure*. These supports can be polymer supports such as cellulosic, polystyrene, polyamide, polyvinyl, polyethylene or polyester polymers, paper or metallic supports.

The photographic products can contain other layers, for example a protective top layer, intermediate layers, an antihalo layer, an antistatic layer etc. These different layers and their arrangements are described in Section XI of *Research Disclosure*.

The invention is described in more detail in the following examples:

EXAMPLE 1

A photographic product was used which comprised an ethylene polyterephthalate (ESTAR®) support covered with a gelatin underlayer (1.8 g/m$^2$) containing a developer (tert-butylhydroquinone (TBHQ), 1.7 g/m$^2$), a co-developer (4-methyl-4-hydroxymethylphenidone, 0.1 g/m$^2$), a hardening agent (bisvinylmethylsulfone, 3.5% by weight based on total dry gelatin). This underlayer was covered with a layer of silver halide emulsion, itself covered with a protective top layer of gelatin (0.8 g/m$^2$).

The silver halide emulsion consisted of cubic grains (0.2 $\mu$m edge) of silver chlorobromide (70 mol. % of chloride) with rhodium added. The grains were chemically sensitized with sulfur ($2.98\times10^{18}$ atoms of sulfur/mol Ag) and with gold ($3.50\times10^{18}$ atoms of gold/mol Ag). The emulsion was blue-sensitized spectrally.

The samples of films having the format described above were first of all immersed in a 3% acetic acid bath in order to perform the fixing step on a wet film reproducing the conditions of use.

Fixing of the film was performed on the wet film by applying a quantity of fixing solution of around 50 ml/m$^2$ with the device of FIG. 2. The composition of the fixing solution is described below. The layer of fixing agent was contacted with the surface of the film for a length of time referred to as the "fixing time", during which the fixing reaction took place. The excess of fixing solution was eliminated by means of a smooth roller. The film was then immersed in water for 2 minutes and then dried.

The fixing level was obtained by measuring the quantity of silver remaining on the film compared with the initial quantity of silver contained in the film, the quantities of silver being determined by X-ray fluorescence: fixing level= initial Q Ag−remaining Q Ag/initial Q Ag.

Composition of the fixing solution

| | |
|---|---|
| Ammonium thiosulfate | 142 g |
| Sodium sulfite | 15.28 g |
| Boric acid | 6.07 g |
| Tartaric acid | 1.5 g |
| Aluminum sulphate | 7.04 g |
| Olin 10 G wetting agent | 3% (vol) |
| pH = 4.10 | |
| Water for obtaining 1 liter of solution | |

In this example, different films having the above format, with a silver content from 2 to 4.4 g/m$^2$, were fixed by surface application. The results set out in Table 1 below were obtained for a contact time of 30 seconds at a temperature of 25° C.

TABLE 1

| Silver content of photographic product | Fixing level (%) |
|---|---|
| 2 g/m$^2$ | 91 |
| 2.6 g/m$^2$ | 70 |
| 3.2 g/m$^2$ | 48 |
| 3.8 g/m$^2$ | 51 |
| 4.4 g/m$^2$ | 45 |

EXAMPLE 2

In this example, a wet film having a silver content of around 3.2 g/m$^2$ was fixed by surface application (47 ml/m$^2$) with a fixing solution having the composition of Example 1 in which the quantity of ammonium thiosulfate was varied from 142 to 426 g/l.

The result set out in Table 2 below were obtained with a contact time of 20 seconds and a temperature of 25° C.

TABLE 2

| Quantity of ammonium thiosulfate | Fixing level (%) |
|---|---|
| 142 g/l | 54 |
| 227 g/l | 87 |
| 355 g/l | 96 |
| 426 g/l | 98 |

These examples show that, with a contact time reduced to 20 seconds, a fixing level of around 90% was obtained when the quantity of ammonium thiosulfate was greater than 200 g/l. A better fixing homogeneity was also observed, that is to say that the fixing level was uniform over the entire film. These examples demonstrate that it is possible to effectively fix films having a silver content, conventional in photography, with a quantity of fixing agent below 50 ml/m$^2$. In order to obtain a comparable fixing level with a conventional fixing process in a tank, it would have been necessary to use a quantity of fixing solution of around 500 ml/m$^2$.

EXAMPLE 3

In this example, the fixing of a wet film having the format described in Example 1 was performed by the application of a layer of the fixing solution previously used containing 230 g/l of ammonium thiosulfate (47 ml/m$^2$) and with a fixing temperature of 40° C.

The results set out in Table 3 were obtained with a film having a silver content of 2.1 g/m$^2$.

The results set out in Table 4 were obtained with a film having a silver content of 3.2 g/m$^2$.

TABLE 3

| Fixing time (seconds) | Fixing level (%) |
|---|---|
| 5 | 41 |
| 10 | 94 |
| 15 | 96 |
| 20 | 97 |

TABLE 4

| Fixing time (seconds) | Fixing level (%) |
|---|---|
| 5 | 42 |
| 10 | 83 |
| 15 | 92 |
| 20 | 91 |
| 25 | 97 |

These examples show that it is possible to obtain effective fixing of a film having a silver content of 3.2 g/m$^2$ with a fixing time of 10 seconds.

EXAMPLE 4

In this example, the fixing of a wet photographic film having the format of Example 1 and a silver content of 3.2 g/m$^2$ was performed by applying, in a layer, a fixing solution having the composition of Example 3 whilst varying the quantity of fixing solution, the layer of fixing solution being applied with the device of FIG. 1. The fixing temperature was 25° C. and the fixing time was 30 seconds. It was thus observed that, by applying a quantity of fixing solution of between 23 and 48 ml/m$^2$, the fixing level was in all cases greater than 95%.

EXAMPLE 5

In this example, the fixing of a wet film having the format of Example 1 was performed by applying a layer of the fixing solution described below, the film having a silver content of 3.2 g/m$^2$.

The fixing temperature was 25° C. and the fixing time was 10 seconds.

Composition of the fixing solution

| | |
|---|---|
| Sodium thiocyanate | 234 g |
| pH | 4.5 |
| OLIN 10G ® wetting agent | 3% (vol) |
| Water for obtaining 1 liter of solution | |

With a fixing solution containing thiocyanate, a fixing level greater than 98% was obtained in 10 seconds.

EXAMPLE 6

In this example, a film having the format of Example 1 was fixed by applying a layer of the fixing solution described below, the film having a silver content of 3.2 g/m$^2$.

The fixing temperature was 25° C. and the fixing time 10 seconds.

Composition of the fixing solution

| | |
|---|---|
| Sodium thiocyanate | 234 g |
| Ammonium thiosulfate | 115 g |
| pH | 4.5 |
| OLIN 10G ® wetting agent | 3% (vol) |
| Water for obtaining 1 liter of solution | |

With this fixing solution, a fixing level of around 98% was obtained in less than 15 seconds.

The invention has been described in detail with particular reference to certain preferred embodiments thereof, but it will be understood that variations and modifications can be effected within the spirit and scope of the invention.

I claim:

1. A method of processing an exposed photographic product which comprises the following steps:

a) developing the photographic product, b) fixing the developed photographic product, and c) washing the photographic product, the fixing step comprising applying to the surface of the photographic product, a layer of an aqueous fixing solution comprising a concentration of thiosulfate or thiocyanate greater than or equal to 200 g/l, and a photographically inert wetting agent.

2. The method of claim 1 wherein the photographic product has a silver content of less than or equal to 5 g/m$^2$, and the amount of fixing solution applied to the photographic product is between 20 and 200 ml/m$^2$.

3. The method of claim 2 wherein the amount of the fixing solution applied to the photographic product is between 25 and 35 ml/m$^2$.

4. The method of claim 1 wherein the fixing solution is applied at a temperature of between 20 and 40° C.

5. The method of claim 1 wherein the fixing solution contains solely a thiosulfate.

6. The method of claim 1 wherein the fixing solution contains solely a thiocyanate.

7. The method of claim 5 wherein the concentration of the thiosulfate is between 200 and 500 g/l.

8. The method of claim 1 wherein the fixing solution comprises both thiosulfate and thiocyanate, the concentration of thiocyanate being between 20 and 30% by weight based on the total quantity of fixing agents.

9. The method of claim 1 wherein the photographic product comprises a support having thereon on at least one of its faces a layer of silver halide emulsion comprising as the main halide, chloride or chlorobromide.

* * * * *